US010323349B2

(12) United States Patent
Takanashi

(10) Patent No.: US 10,323,349 B2
(45) Date of Patent: Jun. 18, 2019

(54) WASHING SYSTEM

(71) Applicant: Kyoudojyutaku Co., Ltd., Urayasu-shi, Chiba-ken (JP)

(72) Inventor: Kentaro Takanashi, Urayasu (JP)

(73) Assignee: Kyoudojyutaku Co., Ltd., Urayasu-shi (JP)

( * ) Notice: Subject to any disclaimer, the term of this patent is extended or adjusted under 35 U.S.C. 154(b) by 0 days.

(21) Appl. No.: 15/073,653

(22) Filed: Mar. 18, 2016

(65) Prior Publication Data

US 2017/0088996 A1 Mar. 30, 2017

Related U.S. Application Data

(60) Provisional application No. 62/232,821, filed on Sep. 25, 2015.

(51) Int. Cl.

| | |
|---|---|
| ***D06F 35/00*** | (2006.01) |
| ***D06F 39/00*** | (2006.01) |
| ***D06F 39/02*** | (2006.01) |
| ***D06F 39/08*** | (2006.01) |
| ***C25B 1/00*** | (2006.01) |

(52) U.S. Cl.

CPC ..... *D06F 35/003* (2013.01); *C25B 1/00* (2013.01); *D06F 39/007* (2013.01); *D06F 39/02* (2013.01); *D06F 39/022* (2013.01); *D06F 39/088* (2013.01); *D06F 2220/00* (2013.01)

(58) Field of Classification Search

CPC ..... D06F 35/003; D06F 9/007; D06F 9/02; D06F 9/022; D06F 9/088

See application file for complete search history.

(56) References Cited

U.S. PATENT DOCUMENTS 6,461,446 B1 * 10/2002 Satoh ..... C11D 3/046 134/42
2002/0023847 A1 * 2/2002 Natsume ..... A47L 15/42 205/687
2003/0109398 A1 * 6/2003 Yoneda ..... A47L 15/42 510/276

(Continued)

FOREIGN PATENT DOCUMENTS

CN 104176793 A * 12/2014
JP 2003144793 5/2003

(Continued)

OTHER PUBLICATIONS

Machine translation of CN 104176793 A to Zhao. (Year: 2014).*
Machine translation of JP 2004275841 A to Tamio. (Year: 2004).*

*Primary Examiner* — Joseph L. Perrin

(57) ABSTRACT

A system for washing clothing includes an alkaline ionized water-generating unit, an alkaline ionized water-generating medium-supplying unit, an alkaline ionized water storage unit, and a washing tub. The alkaline ionized water-generating unit is configured to generate alkaline ionized water. The alkaline ionized water-generating medium-supplying unit is configured to supply the alkaline ionized water-generating medium to the alkaline ionized water-generating unit, and the alkaline ionized water-generating medium generates the alkaline ionized water. The alkaline ionized water storage unit is configured to store the alkaline ionized water generated by the alkaline ionized water-generating unit. The washing tub is configured to wash an object.

10 Claims, 11 Drawing Sheets

(56) References Cited

U.S. PATENT DOCUMENTS

| | | | | |
|---|---|---|---|---|
| 2006/0288743 | A1* | 12/2006 | van Kralingen | C02F 1/469 68/147 |
| 2007/0180866 | A1* | 8/2007 | Cao | D06F 35/003 68/3 R |
| 2011/0162152 | A1* | 7/2011 | Hanau | D06F 58/203 8/137 |
| 2013/0125316 | A1* | 5/2013 | Bhuta | A61L 2/18 8/137 |

FOREIGN PATENT DOCUMENTS

| | | |
|---|---|---|
| JP | 2003200196 | 7/2003 |
| JP | 2003320196 | 11/2003 |
| JP | 2004275841 | 10/2004 |
| JP | 2005313054 | 11/2005 |
| JP | 2006217965 | 8/2006 |
| JP | 2007209546 | 8/2007 |
| JP | 2007268346 | 10/2007 |
| JP | 2013112805 | 6/2013 |

* cited by examiner

WASHING SYSTEM

FIELD OF THE INVENTION

The present invention relates to a washing system, and more particularly to a system for washing clothing and the like.

BACKGROUND OF THE INVENTION

Conventionally, when clothing is washed at homes or at coin laundromats where a plurality of washing machines is provided, washing is performed by using detergent. However, surfactants in synthetic detergents are known to cause skin stimulation or allergy as well as environmental concerns. Accordingly, Yamaji et al. (Japanese patent publication No. 2003-144793) discloses a washing apparatus that alleviates environmental pollution by using alkaline water and acidic water ionized by electrolyzed saline solutions to reduce the need for detergents.

However, the apparatus described by Yamaji requires the installation of a saline solution tank and an ionized water generator for electrolysis. Therefore, the apparatus is disadvantageous in that the salinity may cause rusting on the peripheral and installation of the ionized water generator may result in complications and enlargement of the apparatus.

On the other hand, it has been known that alkaline ionized water with high alkalinity exhibits high washing performance and provides sufficient washing capacity with little or no detergent required. It has also been known that alkaline ionized water neither causes skin stimulation or allergy nor leads to environmental pollution. However, it has been difficult to supply alkaline ionized water with highly stable alkalinity.

SUMMARY OF THE INVENTION

The present invention provides a washing system with a simple configuration that allows washing clothing and the like without using detergents.

According to an embodiment of the present invention, a system for washing clothing is provided. The system for washing clothing includes an alkaline ionized water-generating unit, an alkaline ionized water-generating medium-supplying unit, an alkaline ionized water storage unit, and a washing tub. The alkaline ionized water-generating unit is configured to generate alkaline ionized water. The alkaline ionized water-generating medium-supplying unit is configured to supply the alkaline ionized water-generating medium to the alkaline ionized water-generating unit, and the alkaline ionized water-generating medium generates the alkaline ionized water. The alkaline ionized water storage unit is configured to store the alkaline ionized water generated in the alkaline ionized water-generating unit. The washing tub is configured to wash an object.

In a preferred embodiment of the present invention, the system of washing clothing further includes an adjusting valve disposed on a pipe and configured to connect the alkaline ionized water storage unit to the washing tub. The adjusting valve adjusts a ratio of water supplied directly to the washing tub to the alkaline ionized water supplied from the alkaline ionized water storage unit to the washing tub.

In a preferred embodiment of the present invention, the adjusting valve adjusts the ratio of the water supplied directly to the washing tub to the alkaline ionized water supplied from the alkaline ionized water storage unit to the washing tub to be 5:1.

In a preferred embodiment of the present invention, the alkaline ionized water-generating medium-supplying unit further includes a timer. The alkaline ionized water-generating medium-supplying unit supplies the alkaline ionized water-generating medium to the alkaline ionized water generating unit according to the timer.

In a preferred embodiment of the present invention, the alkaline ionized water-generating medium-supplying unit supplies the alkaline ionized water-generating medium to the alkaline ionized water-generating unit according to an amount of the alkaline ionized water stored in the alkaline ionized water storage unit.

In a preferred embodiment of the present invention, the system for washing clothing includes N of the washing tubs and one or M of the alkaline ionized water generating units, wherein N a number is larger than M.

According to the embodiments, the system for washing clothing of the present invention provides a simple configuration that allows washing clothing and the like without using detergents.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

First Embodiment

Figure 1:
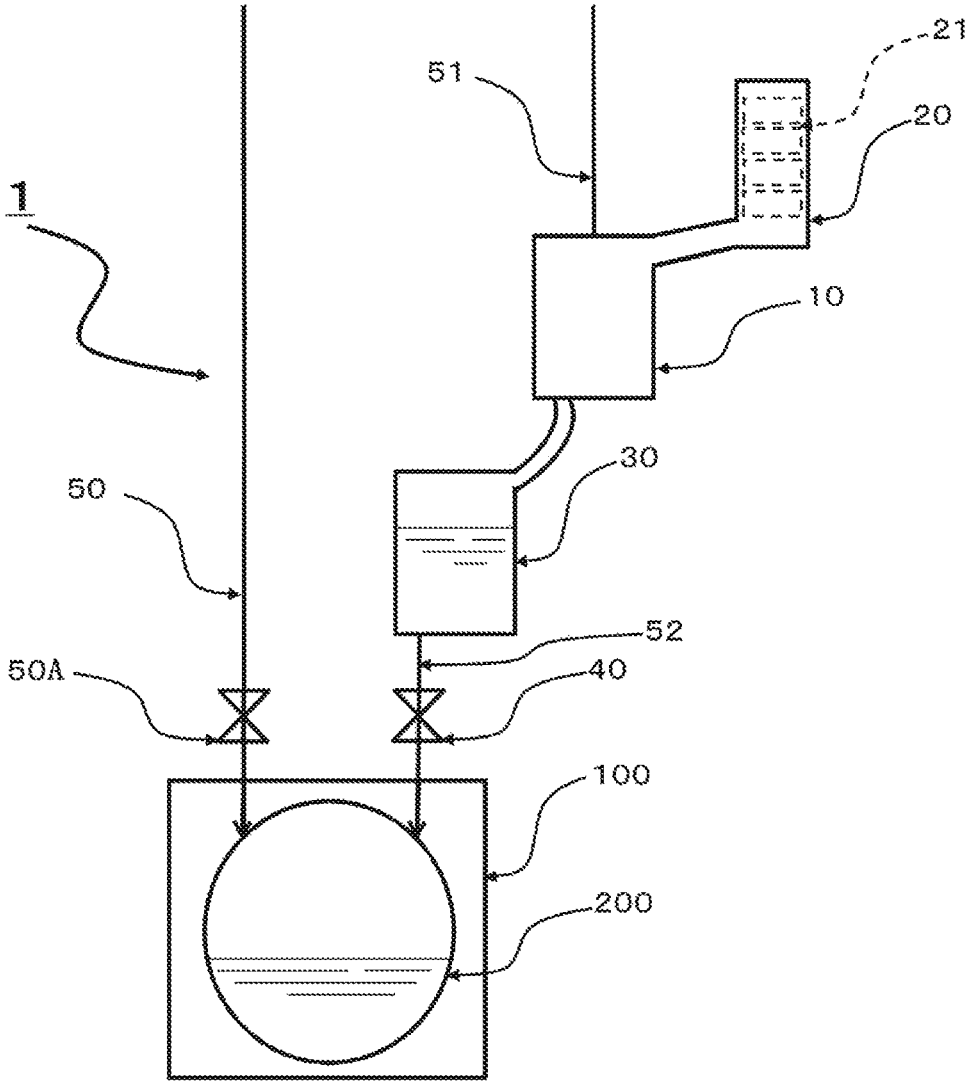
FIG. 1 illustrates a washing system according to a first embodiment of the present invention.

FIG. 1 illustrates a washing system 1 according to a first embodiment of the present invention. The washing system 1 includes an alkaline ionized water-generating unit 10, an alkaline ionized water-generating medium-supplying unit 20 configured to supply an alkaline ionized water-generating medium 21 to the alkaline ionized water-generating unit 10, an alkaline ionized water storage unit 30 configured to store alkaline ionized water generated in the alkaline ionized water-generating unit 10, and a washing tub 100 configured to wash an object. The washing tub 100 includes a drum tub 200.

Water is supplied to the drum tub 200 in the washing tub 100 by a first pipe 50. Water is supplied to the alkaline ionized water-generating unit 10 by a second pipe 51. The alkaline ionized water-generating medium 21 is also supplied from the alkaline ionized water-generating medium-supplying unit 20 to the alkaline ionized water generating unit 10. Therefore, the alkaline ionized water-generating medium-supplying unit 20 includes a plurality of the alkaline ionized water-generating mediums 21, which react with water to produce alkaline ionized water having a pH≥12.5, for example.

The alkaline ionized water generated in the alkaline ionized water-generating unit 10 accumulates over time. Therefore, the alkaline ionized water storage unit 30 stores the alkaline ionized water in preparation for use in the washing tub 100. The alkaline ionized water-generating unit 10 generates alkaline ionized water only.

The alkaline ionized water is supplied from the alkaline ionized water storage unit 30 to the drum tub 200 in the washing tub 100 through a third pipe 52. The alkaline ionized water is supplied by a pump (not illustrated). The third pipe 52 is provided with an adjusting valve 40, which adjusts the amount of alkaline ionized water supplied from the alkaline ionized water storage unit 30 to the drum tub 200. Thereby, the adjusting valve 40 adjusts a ratio of water supplied through the first pipe 50 to alkaline ionized water supplied through the third pipe 52. By adjusting the ratio, an object such as clothing in the washing tub may be washed under a hydrogen ion concentration that is suitable for washing the object.

The ratio of water supplied through the first pipe 50 to alkaline ionized water supplied through the third pipe 52 is preferably 5:1. In addition, the water supplied through the first pipe 50 has a pH of around 7, and the alkaline ionized water supplied through the third pipe 52 has a pH of around 12.5. By supplying the water and alkaline ionized water in the ratio of 5:1 to the washing tub, the alkaline ionized water would be maintained at a pH of around 12, and thus, the washing of clothing and the like may be performed without the use of detergents.

The alkaline ionized water-generating medium-supplying unit 20 may further include a timer (not illustrated) so that the alkaline ionized water-generating medium-supplying unit 20 may supply the alkaline ionized water-generating medium 21 to the alkaline ionized-water generating unit 10 automatically according to the timer. Moreover, the alkaline ionized water-generating medium-supplying unit 20 may also be configured to supply the alkaline ionized water-generating medium 21 to the alkaline ionized water-generating unit 10 according to the amount of alkaline ionized water stored in the alkaline ionized water storage unit 30. In this case, a detecting mean for detecting the amount of stored alkaline ionized water in the alkaline ionized water storage unit 30 is provided to transmit detected information to the alkaline ionized water-generating medium-supplying unit 20.

Water supplied to the alkaline ionized water-generating unit 10 may also be distributed by the first pipe 50. In this case, an adjusting valve or a distributing path for dividing water supplied to the drum tub 200 in the washing tub 100 and that supplied to the alkaline ionized water-generating unit 10 is provided.

A route for supplying the alkaline ionized water through the alkaline ionized water-generating unit 10 and the alkaline ionized water storage unit 30 to the drum tub 200 in the washing tub 100 corresponds to a route for supplying water mixed with detergents to the washing tub 100 in a regular washing system. Therefore, washing clothing and the like may be performed without detergents by installing the alkaline ionized water-generating unit 10 provided with the alkaline ionized water-generating medium-supplying unit 20 and the alkaline ionized water storage unit 30 into a regular washing system. Moreover, the alkaline ionized water-generating unit 10, the alkaline ionized water-generating medium-supplying unit 20, and the alkaline ionized water storage unit 30 may also be configured as one unit and installed into the regular washing system.

An electrolysis auxiliary agent, for example, can be used as the alkaline ionized water-generating medium 21. The electrolysis auxiliary agent may be comprised of potassium carbonate and formed into a solid. If potassium carbonate is used, about 15 liters of the alkaline ionized water having a pH of 12.5 can be generated in one hour. The amount of potassium carbonate supplied to the alkaline ionized water-generating unit 10 is adjusted based on the amount of alkaline ionized water needed for the washing tub 100 and the amount of alkaline ionized water stored in the alkaline ionized water storage unit 30.

The alkaline ionized water-generating medium 21 is formed into a solid in the embodiment; however, the alkaline ionized water-generating medium 21 may also be in powder form in other embodiments. The amount of potassium carbonate supplied to the alkaline ionized water-generating unit 10 may be adjusted based on the amount of the alkaline ionized water desired to be generated or stored.

In the present invention, washing is performed with strong alkaline ionized water, which is defined as having a pH over 10 and suitable for washing. Moreover, according to the present invention, washing is preferably performed with strong alkaline ionized water having a bactericidal pH of over 12. Since stains on clothing or the like are acidic, the stains can be removed more easily when washed in water with a strong alkalinity. Especially, alkaline ionized water with a pH≥12 decomposes and washes off oil stains and cigarette tars.

Since alkaline ionized water is free of synthetic surfactants and the like, bubbles would not be formed and rinsing and washing can be performed at the same time. Thus, remarkable water saving can be achieved, leading to significant cost reduction. Further, since detergents are not used, washing with alkaline ionized water causes no color or smell, and fungi are eliminated by the sterilizing effect of alkaline ionized water, therefore deodorizing during washing.

Figure 2:
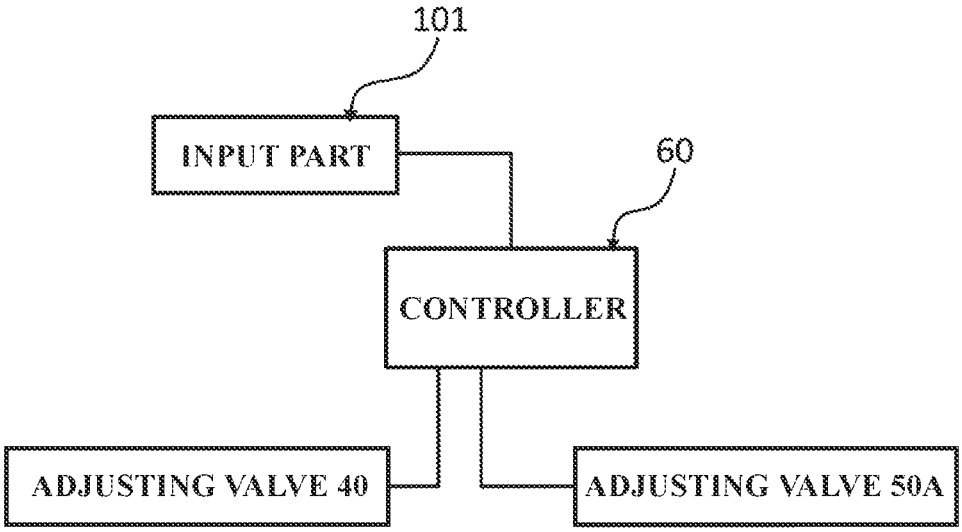
FIG. 2 is a block diagram of configuration of the washing system according to the first embodiment of the present invention.

Next, process in the washing system according to the first embodiment of the present invention is illustrated in FIGS. 2 through 7. FIG. 2 is a block diagram of the configuration of the washing system according to the first embodiment of the present invention.

The washing system includes adjusting valves 40 and 50A, an input part 101 provided with the washing tub 100, and a controller 60 for controlling the adjusting valves 40 and 50A according to a signal provided by the input part 101.

Figure 3:
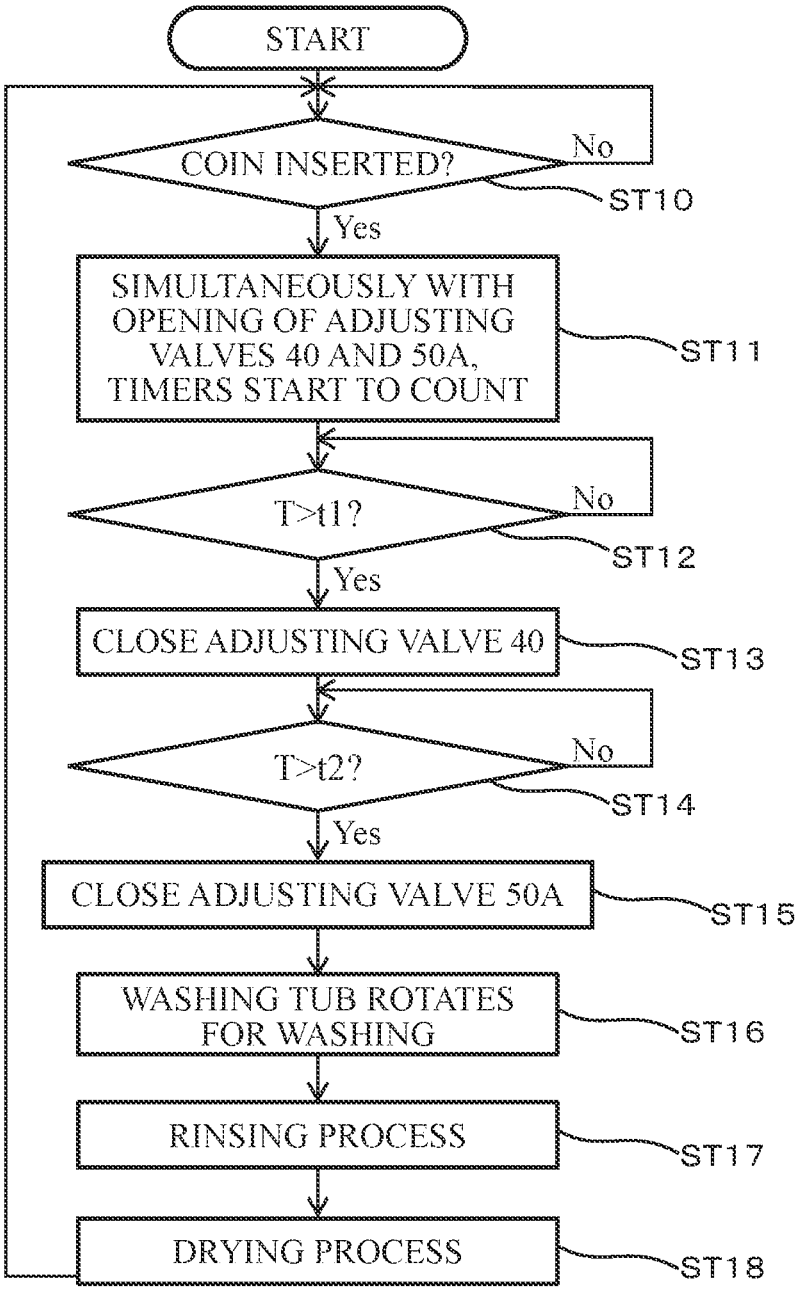
FIG. 3 is a flowchart of the process of the washing system according to the first embodiment of the present invention.

Next, the process of the washing system according to the first embodiment of the present invention is described in detail in FIG. 3. FIG. 3 is a flowchart of the process of the washing system according to the first embodiment of the present invention. Here, a coin-operated washing machine is referred to as the washing system.

First, whether a user has inserted a coin into a coin slot provided on the coin-operated washing machine is determined (Step ST10). If a coin has been inserted, the adjusting valve 40 is opened to supply alkaline ionized water to the washing tub 100. The adjusting valve 50A is also opened to supply tap water to the washing tub 100. Simultaneously, timers for the adjusting valves 40 and 50A start to count (Step ST11).

Whether a timer count T is larger than a predetermined time t1 is determined (Step ST12). When the timer count T is larger than the predetermined time t1 (YES at Step ST12), the controller 60 closes the adjusting valve 40 (Step ST13).

Whether a timer count T is larger than a predetermined time t2 is determined (Step ST14). When the timer count T is larger than the predetermined time t2 (YES at Step ST14), the controller 60 closes the adjusting valve 50A (Step ST15).

The washing tub 100 rotates to wash laundry (Step ST16).

After washing, rinsing is performed in the rinsing process (Step ST17). Lastly, the laundry is dried in the drying process (Step ST18). In this embodiment, washing is performed based on the ratio of the predetermined amount of alkaline ionized water with respect to the predetermined amount of water in a coin-operated washing machine.

Figure 4:
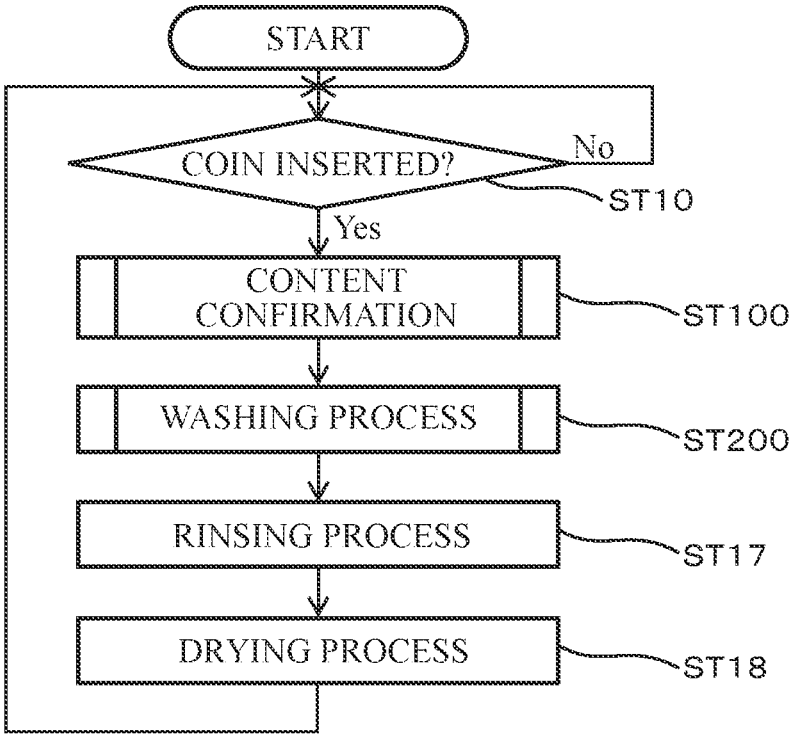
FIG. 4 is a main flowchart of another process of the washing system according to the first embodiment of the present invention.
Figure 5:
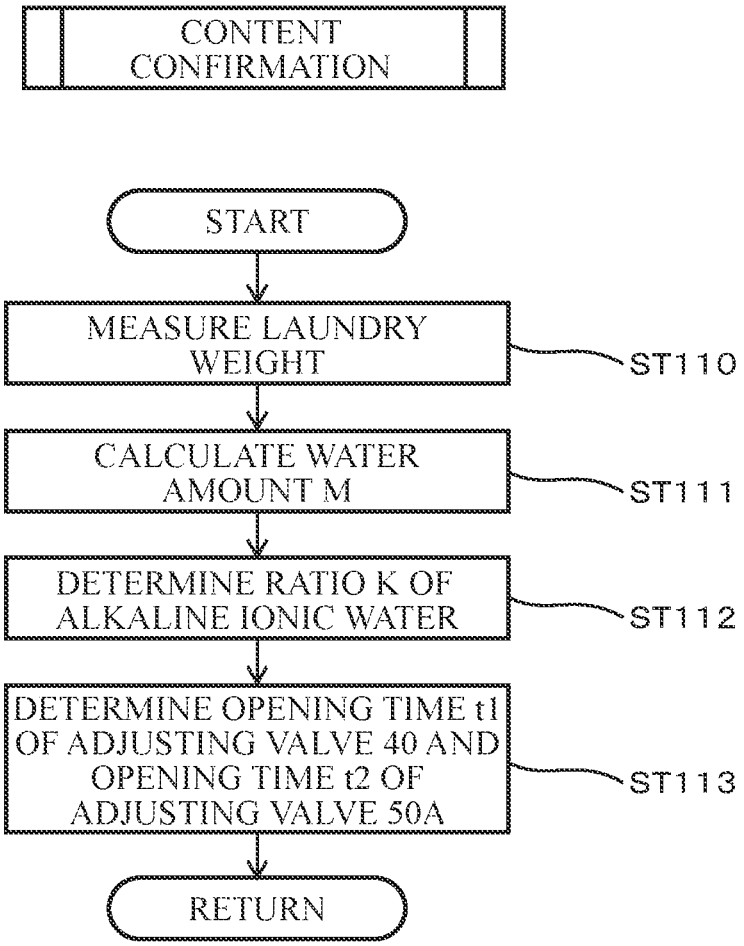
FIG. 5 is a flowchart of a subroutine for performing content confirmation of the washing system according to the first embodiment of the present invention.
Figure 6:
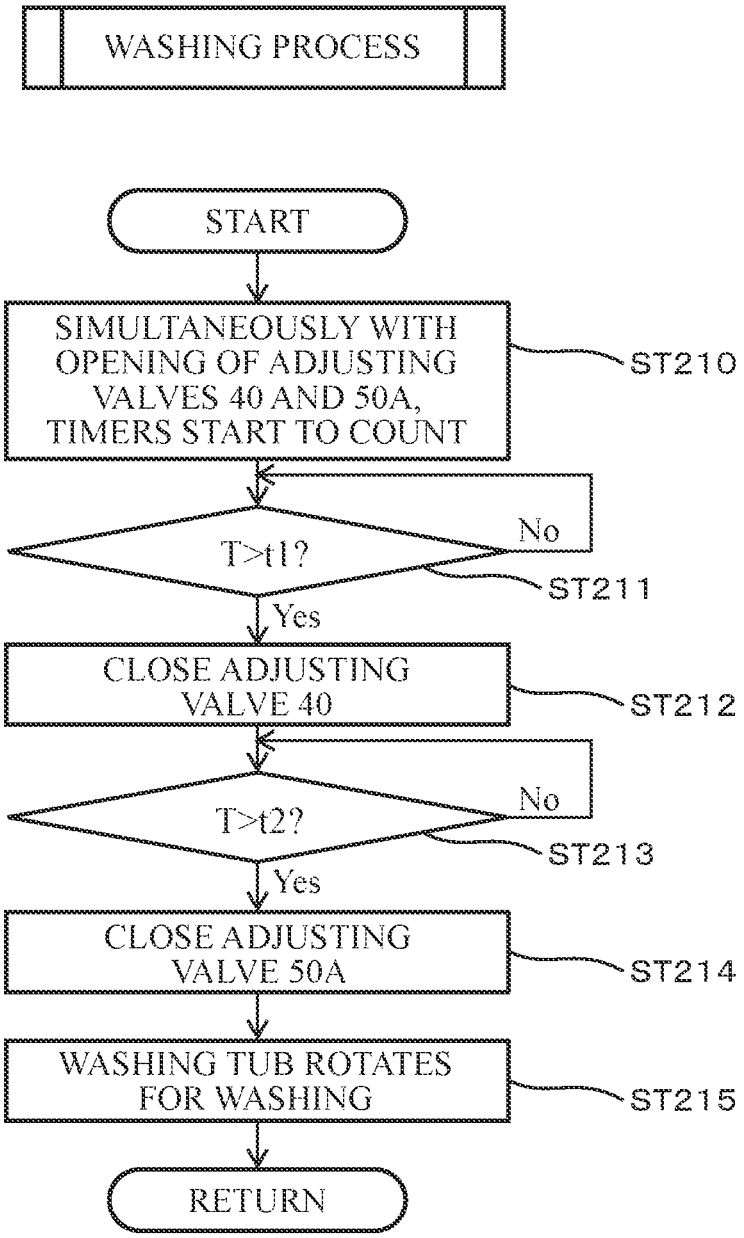
FIG. 6 is a flowchart of a washing subroutine of the washing system according to the first embodiment of the present invention.

Next, another process of the washing system according to the first embodiment of the present invention is described in detail in FIGS. 4 through 7. FIG. 4 is a main flowchart of another process of the washing system according to the first embodiment of the present invention. FIG. 5 is a flowchart of a subroutine for performing content confirmation of the washing system of the first embodiment of the present invention. FIG. 6 is a flowchart of a washing subroutine of the washing system of the first embodiment of the present invention.

The main flow of another process of the washing system according to the first embodiment of the present invention is described in FIG. 4. First, whether a user has inserted a coin into a coin slot provided on the coin-operated washing machine is determined (Step ST10). If a coin has been inserted, content confirmation is performed (Step ST100). Upon confirmation of the content, laundry is washed in the washing process (Step ST200). After washing, rinsing is performed in the rinsing process (Step ST17). Lastly, the laundry is dried in the drying process (Step ST18).

Next, the subroutine flow for performing the content confirmation is described in FIG. 5. In the subroutine, first, weight of laundry is measured (Step ST110). Based on the measured weight, an amount of water M needed for the washing is calculated (Step ST111). A ratio K of the amount of alkaline ionized water with respect to the amount of water M is determined (Step ST112).

Opening time t1 of the adjusting valve 40 and opening time t2 of the adjusting valve 50A are respectively determined according to the ratio K of the amount of alkaline ionized water with respect to the amount of water M (Step ST113).

Next, the subroutine flow of the washing process is described in FIG. 6. In the subroutine, the adjusting valve 40 is opened to supply the alkaline ionized water to the washing tub 100. The adjusting valve 50A is also opened to supply tap water to the washing tub 100. Simultaneously, the timers of the adjusting valves 40 and 50A start to count (Step ST210).

Whether a timer count T is larger than a predetermined opening time t1 is determined (Step ST211). When the time count T is larger than the predetermined opening time t1 (YES at Step ST211), the controller 60 closes the adjusting valve 40 (Step ST212).

Whether a timer count T is larger than a predetermined opening time t2 is determined (Step ST213). When the timer count T is larger than the predetermined opening time t2 (YES at Step ST213), the controller 60 closes the adjusting valve 50A (Step ST214).

The washing tub 100 rotates to wash laundry (Step ST215). After washing, as described above, rinsing is performed in the ringing process (Step ST17). Finally, the laundry is dried in the drying process (Step ST18).

Figure 7:
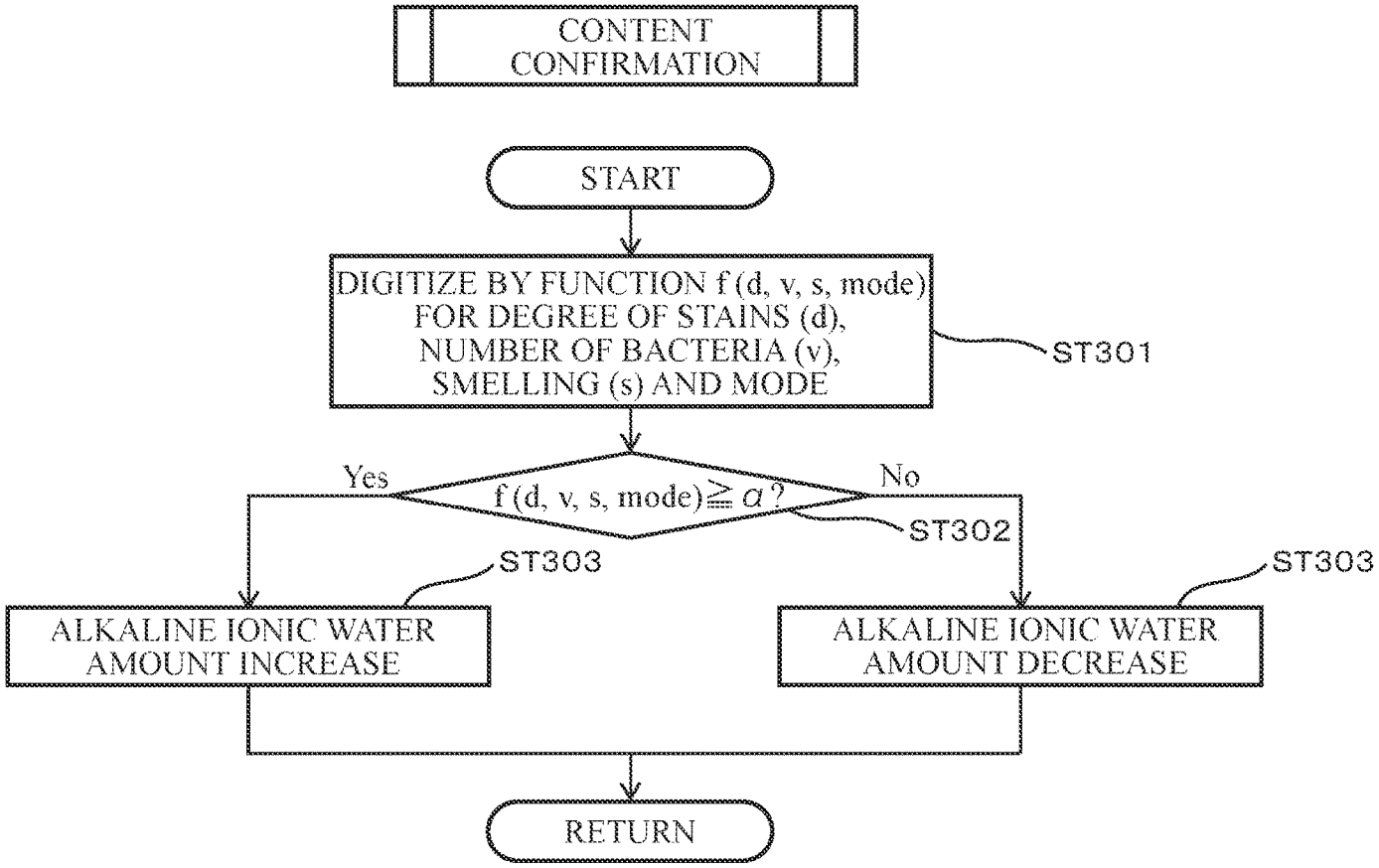
FIG. 7 is a subroutine flowchart for another content-confirmation performance of the washing system according to the first embodiment of the present invention.

Next, another subroutine flow for performing content confirmation of the washing system according to the first embodiment of the present invention is described in FIG. 7.

A digitization is performed by a function f (d, v, s, mode) (Step ST301). Degree of stains (d) as detected by a stain sensor, number of bacteria (v) as detected by a bacteria detecting sensor, smelling (s) as detected by a smell sensor, and mode as selected by a mode selection in the input part 101 are variables of the function f (d, v, s, mode). The stain sensor, the bacteria detecting sensor, the smell sensor, and the input part 101 are provided with the washing tub 100.

A value of the function f (d, v, s, mode) is compared to a predetermined value $\alpha$ (Step ST302). If the value of the function f (d, v, s, mode) is equal to or larger than the predetermined value $\alpha$ (YES at Step ST302), stronger washing capacity would be determined, and the ratio of alkaline ionized water to tap water is increased (Step ST303).

If the value of the function f (d, v, s, mode) is smaller than the predetermined value $\alpha$ (NO at Step ST302), weaker washing capacity would be determined, and the ratio of alkaline ionized water to tap water is decreased (Step ST304).

Second Embodiment

Figure 8:
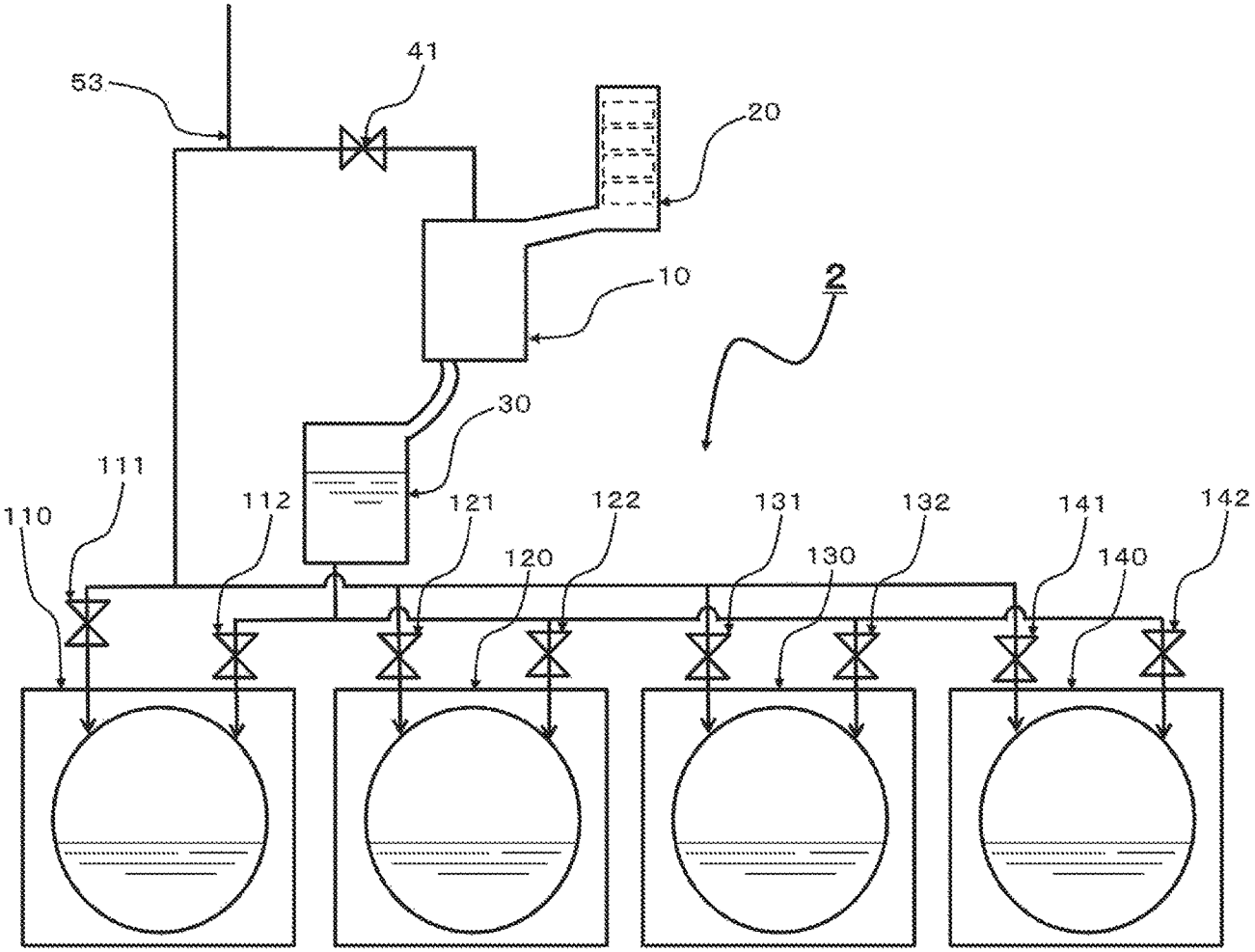
FIG. 8 illustrates a washing system according to a second embodiment of the present invention.

FIG. 8 illustrates a washing system according to a second embodiment of the present invention. A washing system 2 according to the second embodiment of the present invention includes four washing tubs 110, 120, 130 and 140, and one alkaline ionized water-generating unit 10. The alkaline ionized water-generating unit 10 includes an alkaline ionized water-generating medium-supplying unit 20. A fourth pipe 53, disposed at an intermediate portion, branches between the pipes directly supplying water to the four washing tubs 110, 120, 130 and 140 and the pipe supplying water to the alkaline ionized water-generating unit 10 via an adjusting valve 41. The adjusting valve 41 adjusts the amount of water supplied to the alkaline ionized water-generating unit 10.

Each of the pipes directly supplying water to the four washing tubs 110, 120, 130 and 140, includes a corresponding adjusting valve 111, 121, 131 and 141, by which the amount of water supplied to the respective washing tubs is adjusted.

The alkaline ionized water generated in the alkaline ionized water-generating unit 10, by the alkaline ionized water-generating medium in the alkaline ionized water-generating medium-supplying unit 20, is stored in an alkaline ionized water storage unit 30. The alkaline ionized water is supplied to the respective washing tubs 110, 120, 130 and 140 from the alkaline ionized water storage unit 30. In each of the pipes connecting the respective washing tubs 110, 120, 130 and 140 to the alkaline ionized water storage unit 30, a corresponding adjusting valve 112, 122, 132 and 142 for adjusting the amount of alkaline ionized water supply is provided.

Third Embodiment

Figure 9:
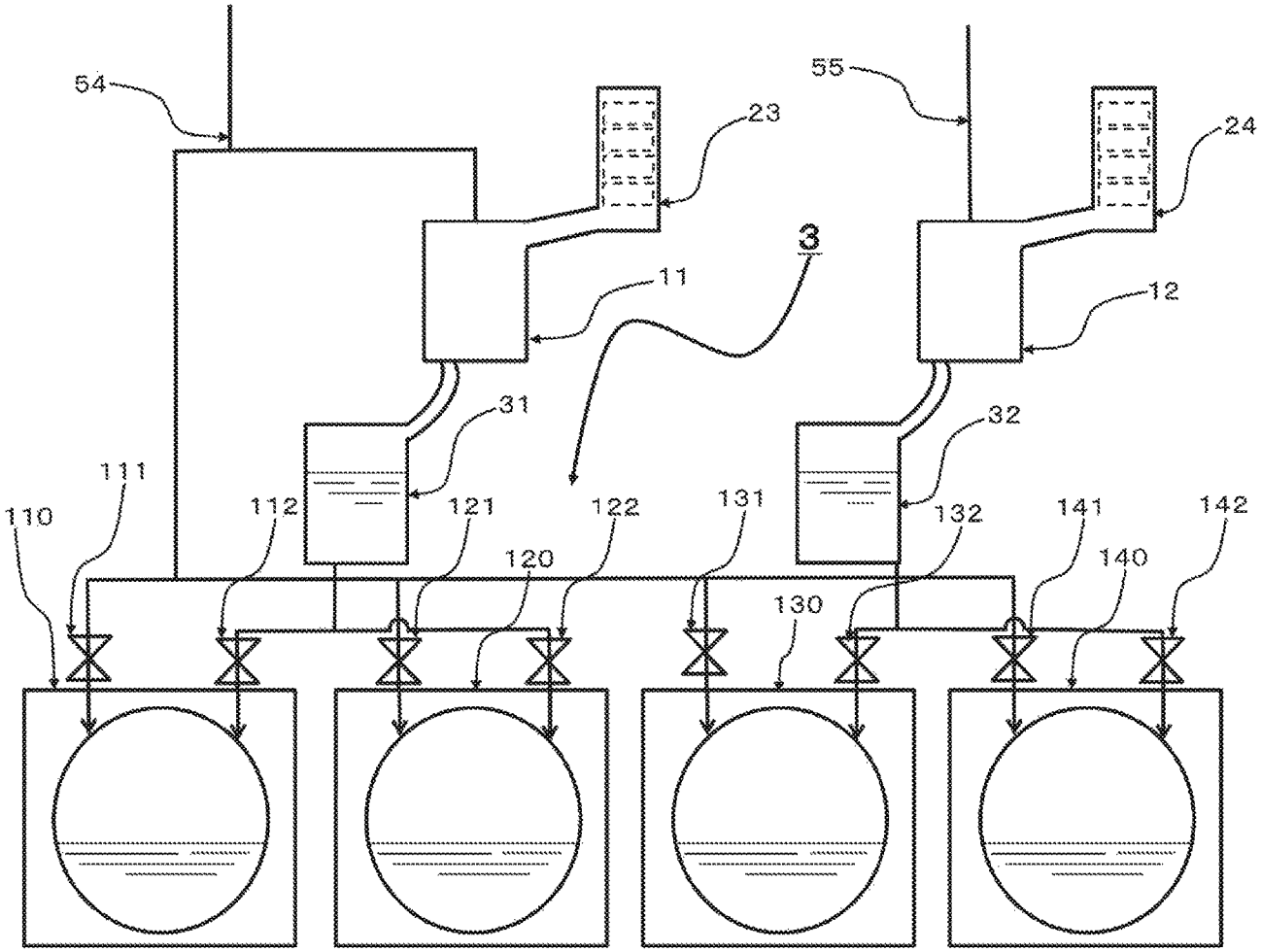
FIG. 9 illustrates a washing system according to a third embodiment of the present invention.

FIG. 9 illustrates a washing system according to a third embodiment of the present invention. A washing system 3 according to the third embodiment of the present invention includes four washing tubs 110, 120, 130 and 140 and two alkaline ionized water-generating units 11 and 12. The alkaline ionized water-generating units 11 and 12 include alkaline ionized water-generating medium-supplying units 23 and 24, respectively. A fifth pipe 54, disposed at an intermediate portion, branches between the pipes directly supplying water to the four washing tubs 110, 120, 130 and 140 and the pipe supplying water to the alkaline ionized water-generating unit 11. On the other hand, water is supplied directly through a sixth pipe 55 to the alkaline ionized water-generating unit 12.

Each of the pipes supplying water directly to the four washing tubs 110, 120, 130 and 140 includes a corresponding adjusting valve 111, 121, 131 and 141, by which the amount of water supplied to the respective washing tubs is adjusted.

The alkaline ionized water generated in the alkaline ionized water-generating unit 11, by the alkaline ionized water-generating medium in the alkaline ionized water-generating medium-supplying unit 23, is stored in an alkaline ionized water storage unit 31. The alkaline ionized water is supplied to the respective washing tubs 110 and 120 from the alkaline ionized water storage unit 31. In each of the pipes connecting the respective washing tubs to the alkaline ionized water storage unit 31, a corresponding adjusting valve 112 and 122 for adjusting the amount of alkaline ionized water supply is provided.

The alkaline ionized water generated in the alkaline ionized water-generating unit 12, by the alkaline ionized water-generating medium in the alkaline ionized water-generating medium-supplying unit 24, is stored in an alkaline ionized water storage unit 32. The alkaline ionized water is supplied to the respective washing tubs 130 and 140 from the alkaline ionized water storage unit 32. In each of the pipes connecting the respective washing tubs to the alkaline ionized water storage unit 32, a corresponding adjusting valve 132 and 142 for adjusting the amount of alkaline ionized water supply is provided.

As described above, by providing one alkaline ionized water-generating medium-supplying unit, one alkaline ionized water-generating unit and one alkaline ionized water storage unit for two washing tubs, sufficient amount of alkaline ionized water can be supplied to the washing tubs. Especially, in the cases where generation of alkaline ionized water by the alkaline ionized water-generating unit takes longer time or where the amount of alkaline ionized water needed for the washing tubs is large, alkaline ionized water can be supplied efficiently.

Figure 10:
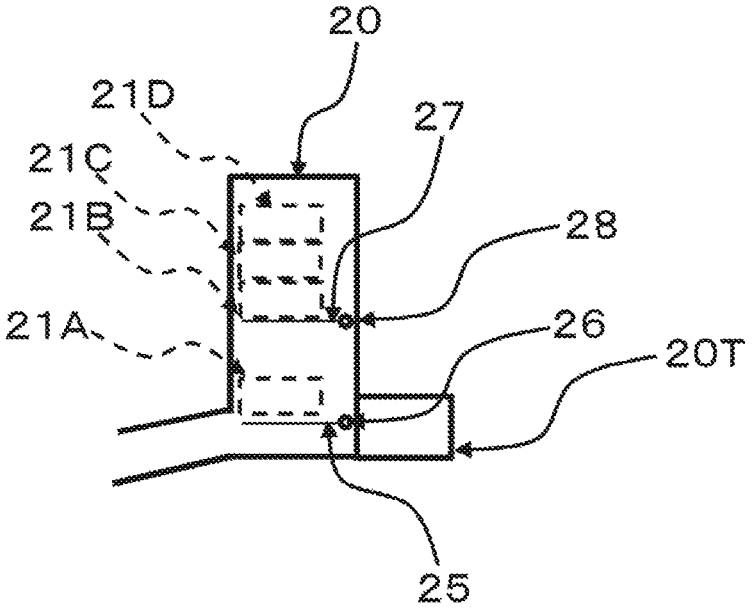
FIGS. 10 and 11 illustrate an alkaline ionized water-generating medium-supplying unit according to the embodiments of the present invention.
Figure 11:
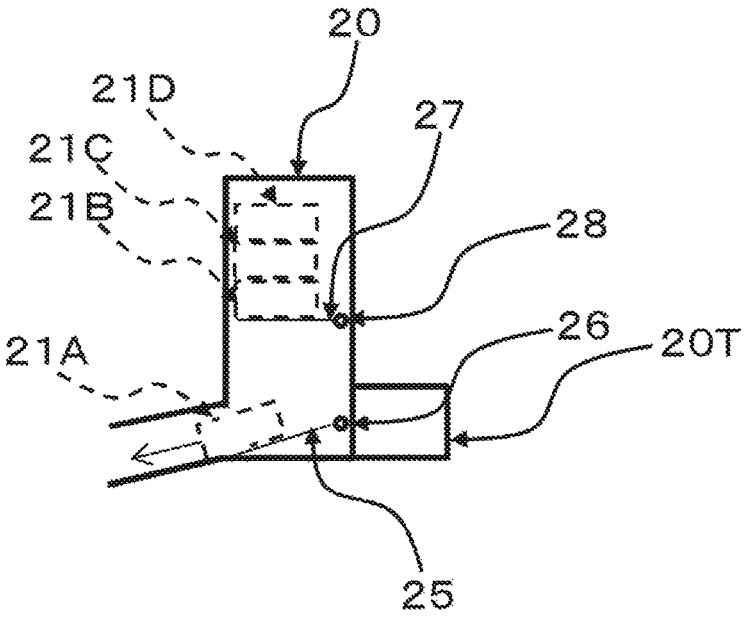

FIGS. 10 and 11 illustrate the alkaline ionized water-generating medium-supplying unit of the washing system according to the embodiments of the present invention. The alkaline ionized water-generating medium-supplying unit 20 includes a timer 20T. The alkaline ionized water-generating medium-supplying unit 20 is configured to accommodate alkaline ionized water-generating mediums 21A, 21B, 21C and 21D. A first plate 25 fixed to a first rotating tool 26 and a second plate 27 fixed to a second rotating tool 28 are provided with the alkaline ionized water-generating medium-supplying unit 20. The first plate 25 supports the alkaline ionized water-generating medium 21A, and the second plate 27 supports the alkaline ionized water-generating mediums 21B, 21C and 21D.

The alkaline ionized water-generating medium-supplying unit 20 supplies the alkaline ionized water-generating medium 21A to the alkaline ionized water-generating unit 10 automatically according to the timer 20T. At this point, the first rotating tool 26 rotates the first plate 25, and the alkaline ionized water-generating medium 21A slides down via the first plate 25 (see FIG. 11) so that the alkaline ionized water-generating medium 21A is supplied to the alkaline ionized water-generating unit 10. When the alkaline ionized water-generating medium 21A is supplied to the alkaline ionized water-generating unit 10, the alkaline ionized water-generating mediums 21B, 21C and 21D are not supplied to the alkaline ionized water-generating unit 10 since the alkaline ionized water-generating mediums 21B, 21C and 21D remain supported by the second plate 27 fixed to the second rotating tool 28. Thus alkaline ionized water-generating mediums are supplied to the alkaline ionized water-generating unit 10 one by one.

At a predetermined interval, for example, every six hours or every eight hours, the timer 20T outputs a signal to the first rotating tool 26 and the second rotating tool 28 to activate the rotating tools 26 and 28. Note that, the second rotating tool 28 may be activated after a predetermined time has passed since the first rotating tool 26 is activated, or after receiving a signal of detecting that the alkaline ionized water-generating medium 21A has slid down via the first plate 25.

Moreover, detecting means that detect the amount of alkaline ionized water stored in the alkaline ionized water storage unit may be provided, so as to supply the alkaline ionized water-generating medium to the alkaline ionized water-generating unit according to the amount of alkaline ionized water stored in the alkaline ionized water storage unit.

In sum, the washing system according to the aforementioned embodiments of the present invention provides necessary amounts of alkaline ionized water to be supplied from the alkaline ionized water storage unit to the washing tub, preferably at a ratio of water directly supplied to the washing tub to alkaline ionized water supplied from the alkaline ionized water storage unit to the washing tub of 5:1, so that objects such as clothing are washed under a suitable hydrogen ion concentration in the washing tub. The alkaline ionized water-generating medium-supplying unit of the present invention may supply the alkaline ionized water-generating medium to the alkaline ionized water-generating unit automatically according to the timer disposed with the alkaline ionized water-generating medium-supplying unit. Furthermore, the alkaline ionized water can be automatically generated in the alkaline ionized water-generating unit, and stored in the alkaline ionized water storage unit; the alkaline ionized water-generating medium-supplying unit can supply the alkaline ionized water-generating medium to the alkaline ionized water-generating unit according to the amount of alkaline ionized water stored in the alkaline ionized water storage unit; and alkaline ionized water needed for the alkaline ionized water storage unit can be automatically generated in the alkaline ionized water-generating unit. Additionally, the washing system of the present invention also allows washing under a suitable hydrogen ion concentration when a plurality of the washing tubs are used, for example at a coin laundromat, by including N of the washing tubs and one or M of the alkaline ionized water-generating units; wherein N is a number larger than M.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A system for washing clothing, comprising:

an alkaline ionized water-generating unit, configured to generate alkaline ionized water;

an alkaline ionized water-generating medium-supplying unit, configured to supply an alkaline ionized water-generating medium to the alkaline ionized water-generating unit, for generating the alkaline ionized water;

an alkaline ionized water storage unit, configured to store the alkaline ionized water generated by the alkaline ionized water-generating unit;

a washing tub, configured to wash an object, wherein the alkaline ionized water-generating unit and the alkaline ionized water storage unit are two spatially separated units;

a controller configured to control a first adjusting valve and a second adjusting valve to control a ratio between alkaline ionized water and water, wherein the ratio is sufficient to wash clothing without adding a detergent; and a pipe, wherein tap water is directly supplied to the washing tub from the pipe to dilute the alkaline ionized water, the alkaline ionized water is diluted by the tap water, and the diluted alkaline ionized water is used for washing clothing without adding a detergent.

2. The system for washing clothing as claimed in claim 1, further comprising an adjusting valve, disposed on a pipe and configured to connect the alkaline ionized water storage unit to the washing tub, wherein the adjusting valve adjusts a ratio of water supplied directly to the washing tub to the alkaline ionized water supplied from the alkaline ionized water storage unit to the washing tub.

3. The system for washing clothing as claimed in claim 2, wherein the adjusting valve adjusts the ratio of the water supplied directly to the washing tub to the alkaline ionized water supplied from the alkaline ionized water storage unit to the washing tub to be 5:1.

4. The system for washing clothing as claimed in claim 1, wherein the alkaline ionized water-generating medium-supplying unit further comprises a timer, and the alkaline ionized water-generating medium-supplying unit supplies the alkaline ionized water-generating medium to the alkaline ionized water-generating unit according to the timer.

5. The system for washing clothing as claimed in claim 1, wherein the alkaline ionized water-generating medium-supplying unit supplies the alkaline ionized water-generating medium to the alkaline ionized water-generating unit according to an amount of the alkaline ionized water stored in the alkaline ionized water storage unit.

6. The system for washing clothing as claimed in claim 1, comprising a plurality of the washing tub and one or more of the alkaline ionized water generating unit, wherein a number of the plurality of the washing tub is larger than a number of the one or more of the alkaline ionized water generating unit.

7. The system for washing clothing as claimed in claim 1, wherein the controller is further configured to determine one or more time frames for closing the first adjusting valve and the second adjusting valve to control the ratio between alkaline ionized water and water.

8. The system for washing clothing as claimed in claim 1, wherein the alkaline ionized water-generating medium-supplying unit comprises a first plate, a second plate, a first rotating tool configured to rotate the first plate, and a second rotating tool.

9. A system for washing clothing as claimed in claim 1, further comprising:

a first washing tub, a second washing tub, a third washing tub, and a fourth washing tub, each configured to wash an object, wherein the alkaline ionized water-generating unit and the alkaline ionized water storage unit are two spatially separated units.

10. A system for washing clothing as claimed in claim 1, further comprising:

a second alkaline ionized water-generating unit, configured to generate alkaline ionized water.

* * * * *